United States Patent [19]

Kilham

[11] 4,432,335

[45] Feb. 21, 1984

[54] STOVE CONSTRUCTION FOR ACHIEVING COMPLETE FUEL COMBUSTION

[76] Inventor: Peter Kilham, Mill Rd., Foster, R.I. 02825

[21] Appl. No.: 327,028

[22] Filed: Dec. 3, 1981

[51] Int. Cl.[3] ..... F24C 1/00

[52] U.S. Cl. ..... 126/60; 126/77; 126/83; 126/290; 126/297

[58] Field of Search ..... 126/77, 112, 15, 297, 126/307 R, 61, 83, 289, 290, 245, 296, 285 A; 110/163, 147

[56] References Cited

U.S. PATENT DOCUMENTS

| | | | |
|---|---|---|---|
| 742,161 | 10/1903 | Cahoone | 126/77 |
| 3,168,088 | 2/1965 | Martin et al. | 126/77 |
| 4,192,285 | 3/1980 | Nietupski | 126/83 |
| 4,359,040 | 11/1982 | Martenson | 126/245 |

*Primary Examiner*—Samuel Scott

*Assistant Examiner*—G. Anderson

*Attorney, Agent, or Firm*—Robert J. Doherty

[57] ABSTRACT

A stove apparatus which is designed to achieve relatively complete combustion of solid fuel such as wood or coal. A combustion chamber is defined by a connected wall housing and includes a primary flue opening at an upper rear portion thereof. Primary combustion air enters into the forward portion of the combustion chamber and the resultant combustion gases are deflected from normally passing to the chimney via the primary exit flue by means of a downwardly extending baffle which creates an increased temperature exit zone adjacent thereto. A device for introducing secondary combustion directly into said exit zone is provided so as to insure more complete combustion and reduce the amount of tars, i.e., creosote, produced in the combustion process. In addition, an unique device for regulating the amount and the combustion chamber is provided.

2 Claims, 7 Drawing Figures

STOVE CONSTRUCTION FOR ACHIEVING COMPLETE FUEL COMBUSTION

BACKGROUND AND OBJECTS OF THE INVENTION

The present invention is directed to a solid fuel, i.e., wood or coal, burning stove apparatus. Generally such stoves include a combustion chamber into which air is directed, burned, and exited through a flue outlet in turn generally positioned centrally at the top of the combustion chamber. With such constructions, a common problem occurs in that tars and other ingredients from the wood or coal which are not completely burned prior to their exit through the flue accumulate on the inside walls of the chimney and upper stove portions thereby creating a fire hazard. Furthermore, such stoves result in a lower efficiency inasmuch as all the solid fuel available is not burned within the combustion chamber.

The present stove construction enables improved efficiency by providing for the more complete combustion of the solid fuel in the combustion chamber. By creating an exit zone whereby combustion gases are retained longer than normal in the combustion chamber, the temperature of such zone is increased, thus assisting in the overall objects of the invention. Secondary combustion air is directly introduced into such zone to further increase combustion efficiency and to reduce the presence of tars and the like, which otherwise could dangerously build up in the chimney, etc. Accordingly, an important object of the present invention is to provide a stove apparatus of the type above-described in which increased burning efficiency of the solid fuel such as wood or coal is achieved therein.

A further object of the present invention is the provision of a stove apparatus which is easy to start and maintain in operation by novice operators and which provides trouble-free operation while burning suitable solid fuel such as coal and wood.

A still further object of the present invention is the provision of a stove apparatus of the type above-described in which an exit zone is created in the combustion chamber wherein combustion gases are retained a longer time than normal and whereby secondary combustion air is directly introduced thereto so as to insure a more complete combustion and subsequent reduction of tars such as creosote in the combustion gases.

These and other objects of the invention are accomplished by a stove construction comprising a housing defining a combustion chamber wherein combustion gases from said burning pass upwardly through a primary flue opening positioned through said housing at an upper rear portion of said chamber, a baffle disposed in said chamber at a position forward and below said primary flue opening so as to downwardly deflect said combustion gases from upper parts of said chamber into an exit zone adjacent said baffle and located within said chamber, primary draft means for introducing primary combustion air into said chamber and means for introducing secondary air directly into said exit zone so as to more completely burn said combustion gases and in turn reduce tars and creosote therein and to raise the combustion efficiency of said stove.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 3:
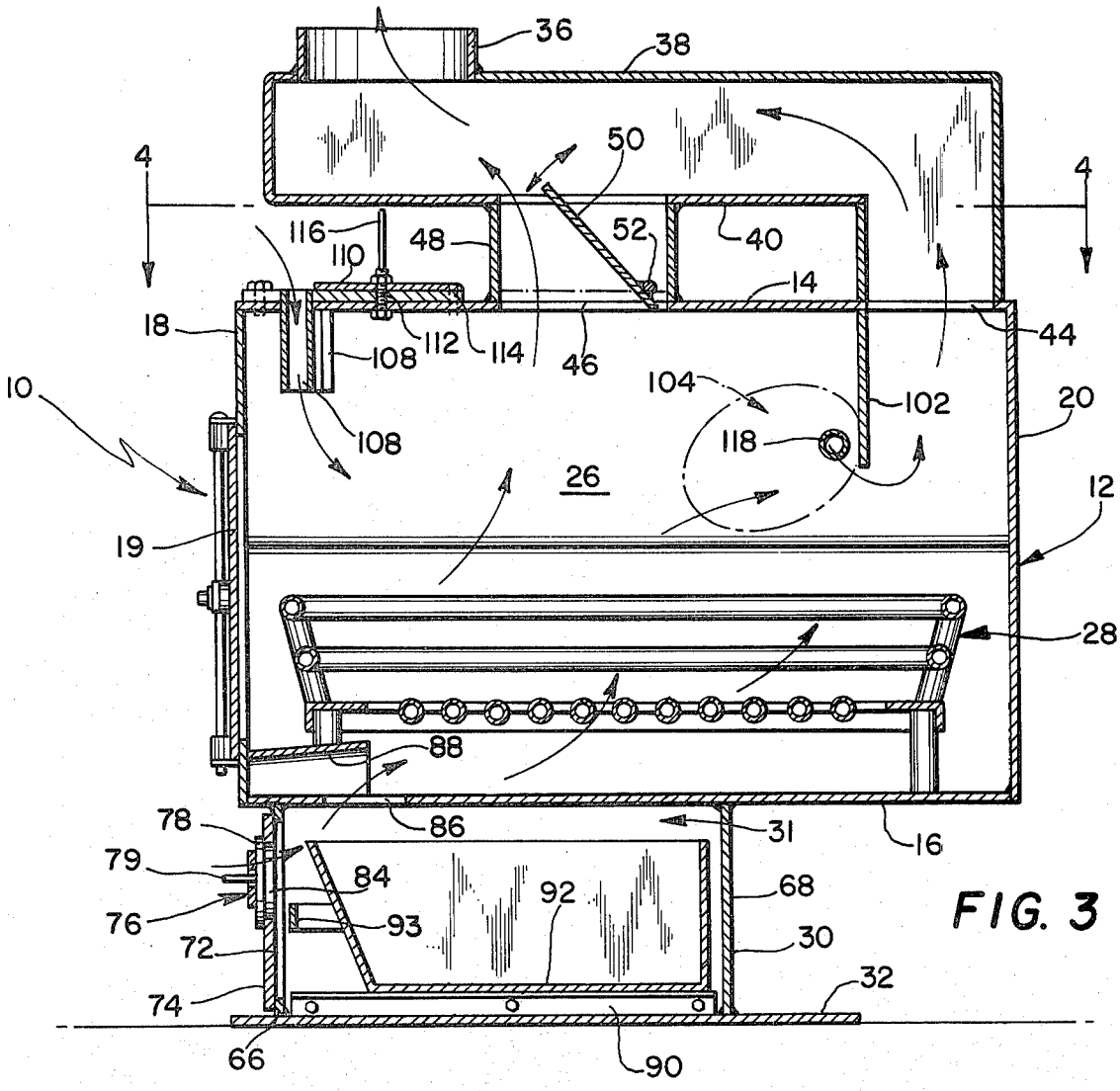
FIG. 3 is a sectional elevational view taken along the line 3—3 of FIG. 1 and shows in particular the inside configuration of the stove.
Figure 4:
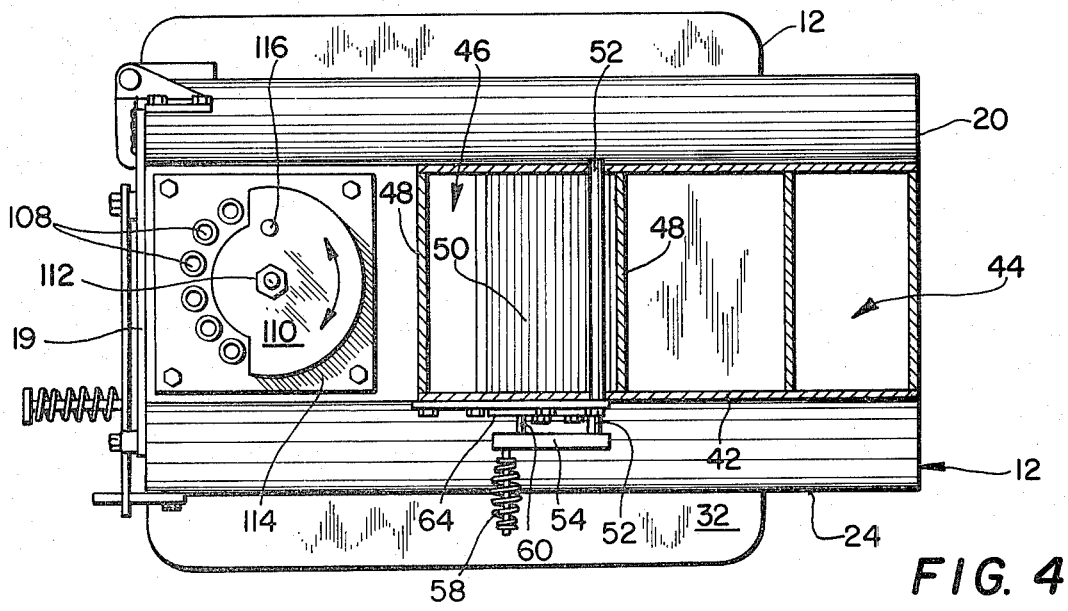
FIG. 4 is a sectional view taken along the line 4—4 of FIG. 3 and in particular shows the construction of both the exhaust chamber and the means by which primary combustion air is admitted to the combustion chamber.

Referring to all the drawings but more particularly to FIGS. 1 through 4 thereof, the stove apparatus 10 of the present invention is preferably constructed of a series of heavy iron plates welded together to define a stove housing 12. Such housing 12 includes top and bottom walls 14 and 16 respectively, front and rear walls 18 and 20 respectively, and connecting side walls 22 and 24. Such walls cooperatively form a combustion chamber 26 wherein a suitable solid fuel such as wood or coal may be burned directly. The front wall includes an opening normally closed by a conventional door 19. In the case of burning coal, a basket-type grate 28 such as shown in FIG. 3 of the drawings is preferably utilized wherein wood may be burned by piling such directly on the bottom wall 16. A grate of suitable construction may also be utilized when utilizing wood as the fuel, if desired.

An ash chamber housing 30 is disposed at the lower end of the housing 12 and in turn is supported by a foot or support 32 of generally planar configuration. The housing 30 defines an ash chamber 31. The upper end of the housing 12 is provided with an exhaust chamber 34 which leads to a chimney connection 36 whereby exhaust gas from the combustion chamber may exit to the chimney proper (not shown). The exhaust chamber 34 is generally of a longitudinal orientation and includes upper and lower walls 38 and 40 respectively and connecting side walls 42. The bottom wall 40 of the chamber 34 is spaced from the top wall 14 of the housing 12.

At the upper rear quadrant of the combustion chamber 26 and adjacent the rear housing wall 20, a primary flue opening 44 through the top wall 14 is provided such that combustion gases formed by the burning of the fuel in the combustion chamber 26 may enter the exhaust chamber and thence to the chimney via the connection 36. Such a rear exit and the resultant forward direction of the exhaust gases in the exhaust chamber 34 increases the area of heat radiating metal surface of the stove and, accordingly, lends to the greater degree of heat being passed into the room in which the stove is utilized.

Figure 1:
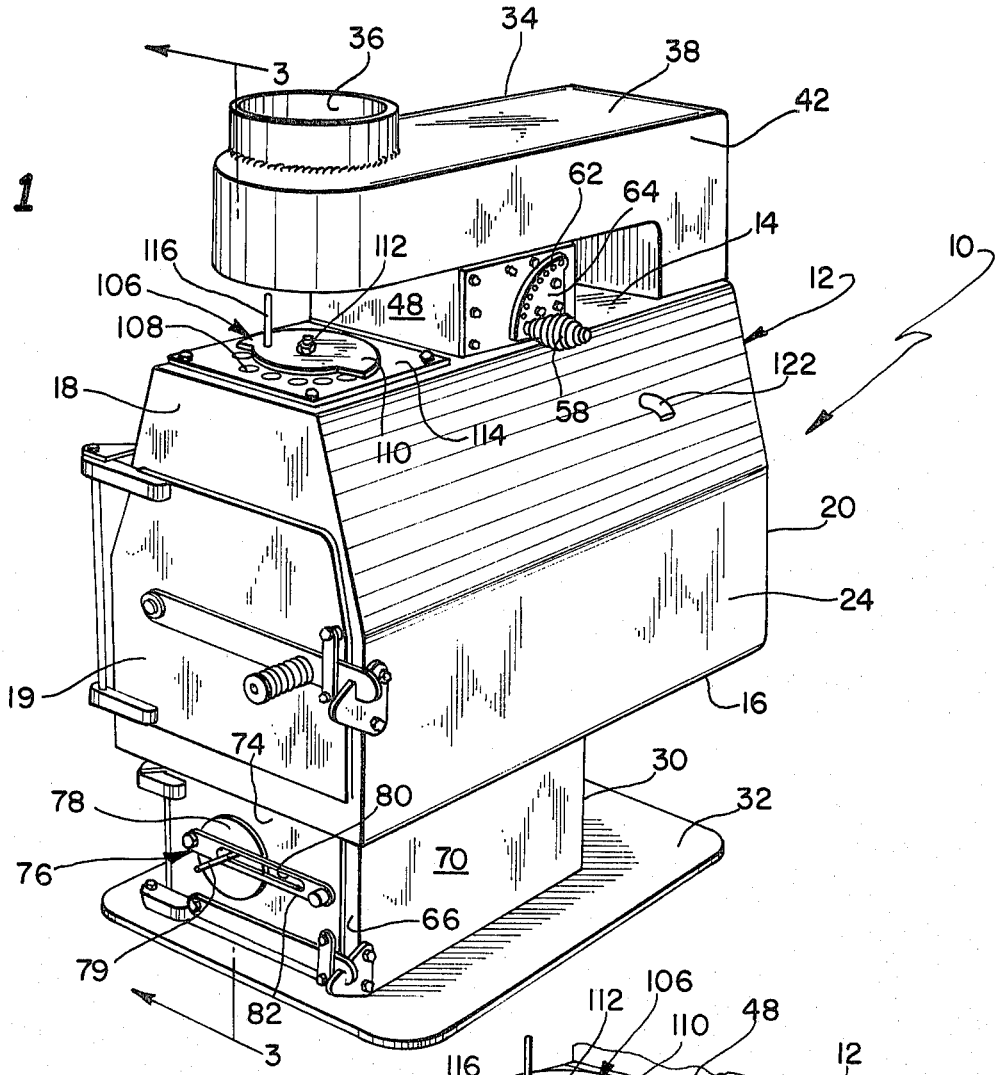
FIG. 1 is a perspective view illustrating a stove apparatus constructed in accordance with the present invention.
Figure 2:
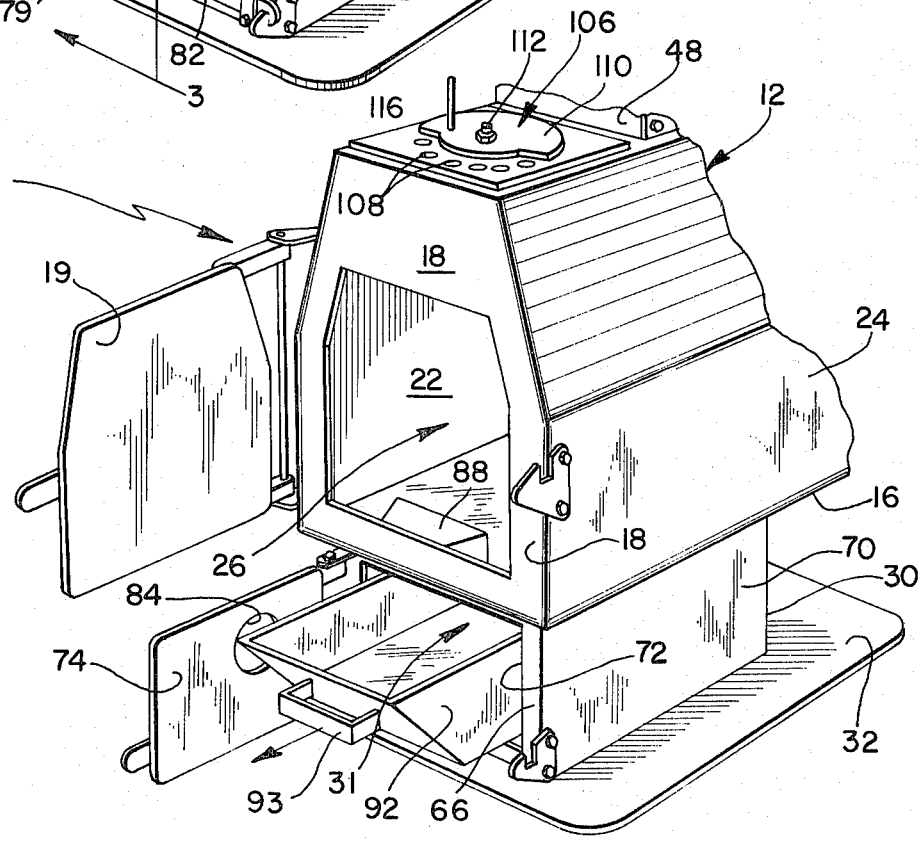
FIG. 2 is a partial perspective view similar to FIG. 1 but showing the doors of the ash and combustion chambers in an open position.

Centrally of the top wall 14, another flue opening 46 is provided through which by means of an upwardly extending collar 48, a second connection is provided into the exhaust chamber 34 from the combustion chamber 26. Such opening is provided with a pivotal damper 50 including an attached rod-like arm 52 which is laterally slidable. The arm 52 is in turn provided with a handle 54 by which the damper 50 may be pivoted back and forth to control the amount of exit draft primarily available for starting a fire in the combustion chamber 26. The handle 54 is further provided with a heat dissipating grip element 58 and an inwardly directed stop peg 60. The peg 60 is in turn adapted to contact a plurality of blind openings 62 provided in an arcuate plate 64 mounted on one of the walls of the collar 48 to adjust the position to the handle 54. Thus by sliding the handle to the side or to the right as shown in FIG. 1, the handle is free to pivot back and forth and thus control the extent of the opening or closing of the damper 50 and by sliding the handle forwardly or the left as shown in FIG. 1 and by simultaneously engaging the peg 60 in one of the openings 62, the desired position of the damper 50 is maintained.

The ash chamber housing 30 is formed from front and rear walls 66 and 68 respectively and by connecting side walls 70. The front wall 66 includes a major opening 72 which is normally closed by a hinged door 74. The door 74 is further provided with a secondary draft mechanism 76 in the form of a plate 78 with a handle 79 and adapted to slide laterally back and forth within the confines of a slot 80 defined in a bar 82 to progressively uncover and cover an opening 84 present in the door 74. By this or other means, the amount of combustion air available for starting fires in the combustion chamber 26 may be regulated.

The additional secondary combustion air admitted through the ash chamber 31 is directed upwardly into the combustion chamber 26 by means of an opening 86 located in the forward portion of the bottom wall 16 of the housing 12 and by means of a cowl 88 disposed in the front portion of the chamber 26 at the front wall 18 and extending rearwardly to a position above the opening 86. In this way, air may pass through the device 76, through the opening 86 and be directed in a rearward direction up into the base of a fire fire present in the combustion chamber 26. Normally the device 76 is used in conjunction with the damper 50 so that fires may be quickly started through the advantage of a straight-through draft. Fires operating with such draft, however, are not normally efficient and accordingly once the fire is underway, the damper is generally positioned in a completely closed position as is the additional secondary combustion air device 76. At that time primary combustion air is supplied in a manner hereinafter described.

The ash chamber 31 further includes a pair of laterally spaced rails 90 attached to the support 32 and on which an ash drawer 92 of any suitable construction may be mounted for sliding movement in and out of the ash chamber 31. A handle 93 is mounted on the forward wall of the ash drawer 92 for such purpose. It should be pointed out that after or even during a fire, ash accumulated within the combustion chamber may be directed downwardly into the ash chamber 31 and into the ash drawer 92 via the opening 86 as by simple sweeping or brushing with a suitable implement.

Figure 7:
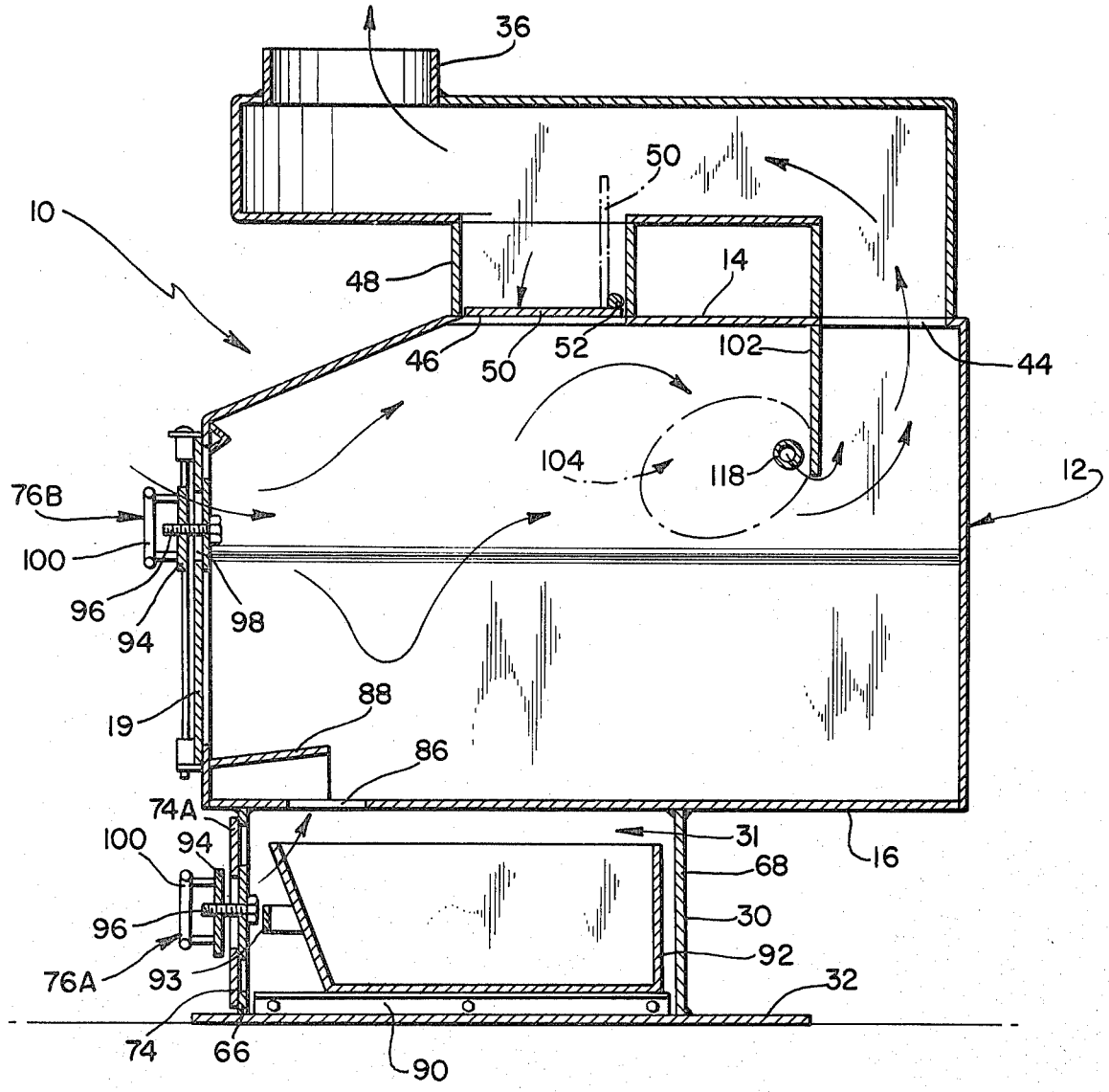
FIG. 7 is a side sectional view similar to FIG. 3 but taken along the line 7—7 of FIG. 5 which shows in particular the inside construction of the modified form stove apparatus.

Other forms of devices for admitting additional secondary combustion air to the combustion chamber 26 may be utilized such as the device 76A shown in FIG. 7. Such device 76A is a rotationally adjustable draft inlet such that the amount of air or draft present in the ash chamber 31 and thus available to be drawn upwardly into the combustion chamber 26 may be varied. Such device includes a closure disc 94 mounted on a threaded post 96 and adapted to move inwardly and outwardly with respect to an opening 98 provided in the door 74A and in turn supported by a webbed frame (not shown) to which such threaded post may be secured. The disc 94 includes an outwardly extending hand-engagable wheel 100 which remains relatively cool and through which the disc may be rotated with respect to the fixed post 96 and thus move inwardly and outwardly with respect to the opening 98.

Turning now to FIGS. 3 and 7 of the drawings in particular, a baffle 102 extends downwardly from the upper wall 14 of the housing 12. Such baffle 102 generally extends across the entire width of the housing, that is, between the connecting side walls 22 and 24 thereof and thus serves to deflect combustion gases present in the upper part of the combustion chamber 26 downwardly into an exit zone 104 forwardly adjacent the lower end of such baffle 102 prior to being permitted to move upwardly into the exhaust chamber via the opening 44 in the top wall 14 of the housing. Generally during normal combustion, the damper 50 is in a closed or at least a partially closed position such that most of the combustion gases pass through the opening 44 and thus thereafter circuitiously through the exhaust chamber 34.

In order to provide primary combustion to the combustion chamber 26 for burning of the fuel present therein, primary draft means 106 are provided in the form of a plurality of separate downwardly extending tubes 108 positioned in the forward part of the top wall 14 of the housing 12. Such tubes are open at both their lower and upper ends such that air may be drawn from the front of the stove 10 downwardly rearwardly towards the fuel in the center lower portion of the combustion chamber 26. In order to regulate the amount of primary combustion air passing through such device 106 and so as to not reduce the velocity at which such is directed towards the burning fuel, the series of separate tubes 108 is utilized rather than a larger single tube. Also in order to regulate the volume of air, a shutout device is provided at the forward end of the top wall 14. Such device is in the form of a flat plate 110 generally of partially circular configuration and attached to the upper wall 14 by means of a connection 112 allowing the plate 110 to rotate about such connection 112. An intermediate plate 114 may be attached to the top wall 14 to in turn serve as the connection by which the upper portions of the tubes 108 may be assembled in the desired manner. Accordingly as the plate 110 is rotated, it will cover one or more of the upper openings of the tubes 108 and in that manner regulate the amount of primary combustion draft entering the combustion chamber 26. In order to grasp the plate 110 to in turn swivel it about its connection 112, an upright handle 116 is provided.

Figure 5:
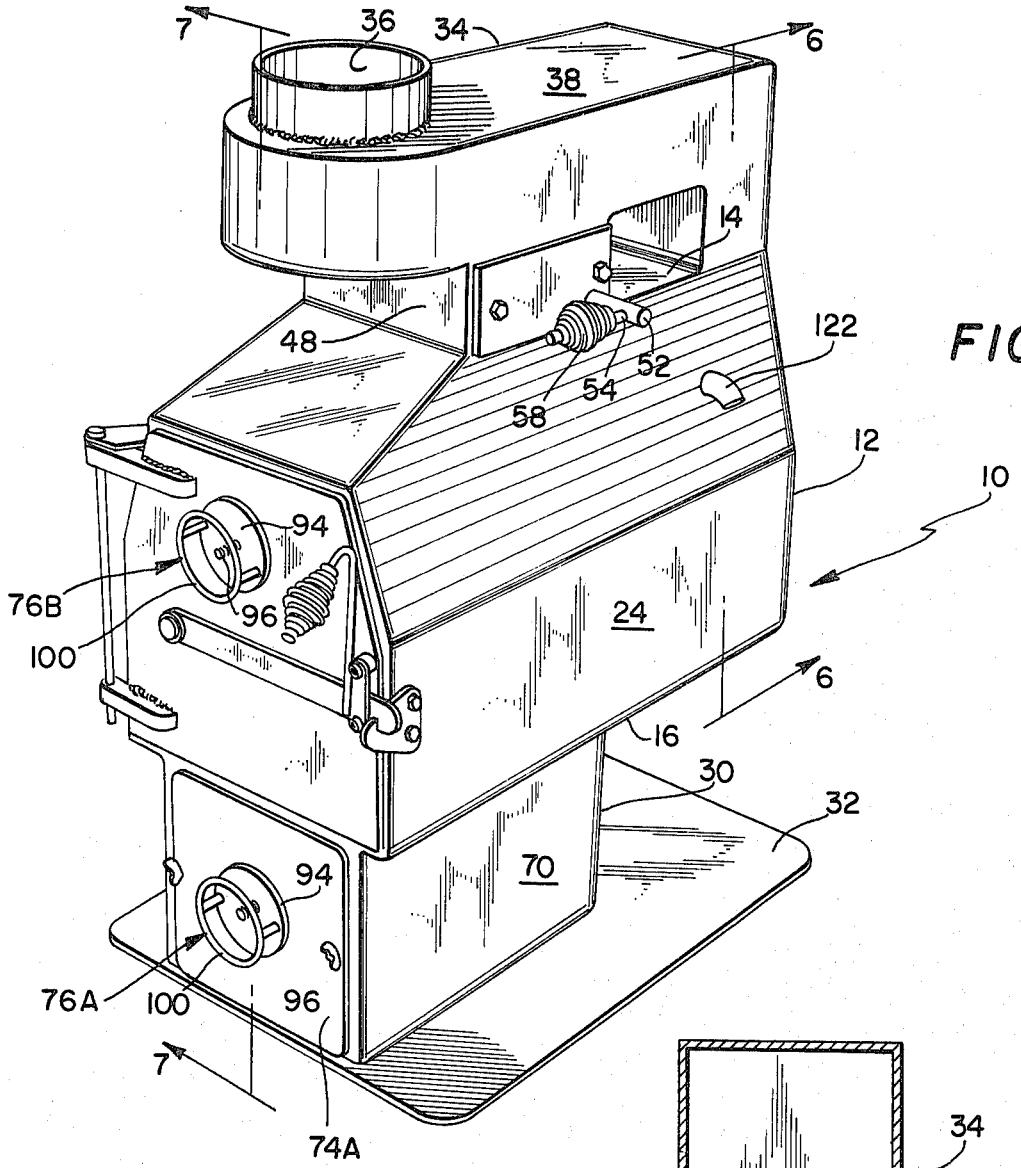
FIG. 5 is a perspective view similar to FIG. 1 but showing a modified form of the stove apparatus.
Figure 6:
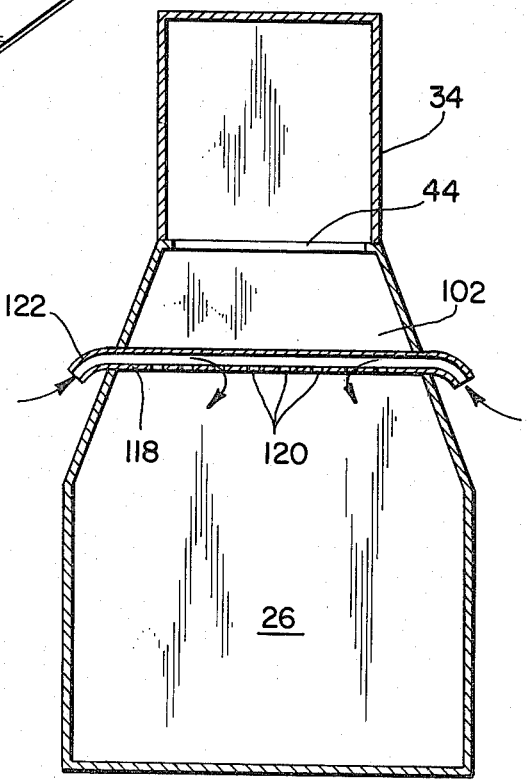
FIG. 6 is a sectional elevational view taken along the line 6—6 of FIG. 5 and shows in particular the means by which secondary combustion air may be admitted directly into the exit zone of the combustion chamber.

The simpler version of the stove shown in FIGS. 5–7 may eliminate the draft tubes above described and utilize a primary draft means mounted in the front door 19 in the form of a second draft device 76B essentially the same as devices 76 and 76A. As may best be seen by simultaneous reference to FIGS. 1, 3, and 5 through 7, means are also provided for directly introducing secondary combustion air into the exit zone 104. Such means may take the form of a pipe 118 extending between the sides 22 and 24 of the combustion chamber 26 and provided with a plurality of openings 120 in the bottom wall thereof. The opposite ends of the pipe 118 are provided with down turned elbows 122 in order to prevent lateral shift of the pipe 118 vis-a-vis the housing 12 and to further prevent foreign materials such as sticks and the like being introduced into the combustion chamber 26 inadvertently as by children and the like.

Thus in normal underway operation, the damper 50 is closed as is the additional secondary combustion air inlet 76 or 76A. In such operational manner, one or more of the tubes 108 of primary draft means 106 is open so as to permit the primary combustion air into the combustion chamber 26 in the desired manner. In the FIGS. 5–7 embodiment, the primary draft means 76B is open to admit the desired amount of air to chamber 26. Combustion gases formed in the combustion chamber pass upwardly to the upper central portion of the chamber and then are forced downwardly rearwardly by the baffle 102. Since the gases are held longer than normal in this exit zone, they produce an area of high temperature within this zone 104. It it into this zone that secondary combustion air is directly introduced so as to provide for a more complete combustion of solid material as in the form of entrained and vaporized, but unburned pitch, creosote and the like that is often present in the combustion gases. Accordingly, by added burning such solid material in this normally high temperature exit zone 104, not only is an increased efficiency of the combustion process achieved but furthermore, potentially harmful pitch or creosote is further consumed in this area so as to not be available to coat the inside surfaces of the exhaust chamber 34 and the chimney itself. In this manner then, increased burning efficiencies and safety factors are achieved in the intended manner of the invention. Also the positioning of the main flue 44 at the rear of the combustion chamber and rearwardly of the exit zone 104 further insures that the combustion gases passing outwardly thereof are forwardly directed over the top surface 14 of the stove housing itself so as to create a greater area of stove metal which may radiate heat into the room in which the stove is being utilized.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A heating stove for the efficient burning of a suitable fuel such as coal or wood comprising, a stove housing defining a combustion chamber wherein combustion gases from said burning pass upwardly through a primary flue opening positioned through said housing at an upper rear portion of said chamber, a baffle disposed in said chamber at a position forward and below said primary flue opening so as to downwardly deflect said combustion gases from upper parts of said chamber into an exit zone adjacent said baffle and located within said chamber, primary draft means for introducing primary combustion air into said chamber and means for introducing secondary combustion air directly into said exit zone so as to more completely burn combustible material in said combustion gases to as to in turn reduce creosote therein and to raise the combustion efficiency of said stove, said housing including top, bottom, front, rear and connecting walls which define said combustion chamber, said primary flue opening disposed in said top wall at a position adjacent said rear wall, said primary draft means including a plurality of separate draft tubes downwardly extending from the forward portion of said top wall into said combustion chamber for directing primary combustion air downwardly towards the housing bottom wall and the base of the burning fuel supported thereby, including a swivable plate mounted on said top wall and movable to progressively cover the tops of one or more of said tubes so as to regulate the amount of primary combustion air passing into said combustion chamber.

2. A heating stove for the efficient burning of a suitable fuel such as coal or wood comprising, a stove housing defining a combustion chamber wherein combustion gases from said burning pass upwardly through a primary flue opening positioned through said housing at an upper rear portion of said chamber, a baffle disposed in said chamber at a position forward and below said primary flue opening so as to downwardly deflect said combustion gases from upper parts of said chamber into an exit zone adjacent said baffle and located within said chamber, primary draft means for introducing primary combustion air into said chamber, and means for introducing secondary combustion air directly into said exit zone so as to more completely burn combustible material in said combustion gases so as to in turn reduce creosote therein and to raise the combustion efficiency of said stove, said primary draft means disposed through an upper forward portion of said housing, said primary draft means including a plurality of separate draft tubes downwardly extending from the forward portion of said top wall into said combustion chamber for directing primary combustion air downwardly towards the housing bottom wall and the base of the burning fuel supported thereby, including a swivable plate mounted on said top wall and movable to progressively cover the tops of of one or more of said tubes so as to regulate the amount of primary combustion air passing into said combustion chamber.

* * * * *